US010871034B2

(12) United States Patent
Dietz et al.

(10) Patent No.: US 10,871,034 B2
(45) Date of Patent: Dec. 22, 2020

(54) WHIPSTOCK ASSEMBLY WITH A SUPPORT MEMBER

(71) Applicant: Halliburton Energy Services, Inc., Houston, TX (US)

(72) Inventors: Wesley P. Dietz, Carrollton, TX (US); William W. Dancer, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 16/060,370

(22) PCT Filed: Feb. 26, 2016

(86) PCT No.: PCT/US2016/019921
§ 371 (c)(1),
(2) Date: Jun. 7, 2018

(87) PCT Pub. No.: WO2017/146736
PCT Pub. Date: Aug. 31, 2017

(65) Prior Publication Data
US 2018/0363378 A1 Dec. 20, 2018

(51) Int. Cl.
*E21B 7/06* (2006.01)
*E21B 7/04* (2006.01)
*E21B 41/00* (2006.01)

(52) U.S. Cl.
CPC ..... *E21B 7/061* (2013.01); *E21B 7/046* (2013.01); *E21B 7/06* (2013.01); *E21B 41/0035* (2013.01)

(58) Field of Classification Search
CPC . E21B 7/061; E21B 7/06; E21B 7/046; E21B 41/0035; E21B 7/08
See application file for complete search history.

(56) References Cited

U.S. PATENT DOCUMENTS

| | | | |
|---|---|---|---|
| 2,338,788 | A | 1/1944 | Walker |
| 4,429,741 | A | 2/1984 | Hyland |
| 5,109,924 | A | 5/1992 | Jürgens et al. |
| 5,193,620 | A | 3/1993 | Braddick |
| 5,379,845 | A | 1/1995 | Blount et al. |
| 5,445,222 | A | 8/1995 | Pritchard et al. |
| 5,452,759 | A | 9/1995 | Carter et al. |
| 5,720,349 | A | 2/1998 | Pleasants et al. |

(Continued)

FOREIGN PATENT DOCUMENTS

| | | |
|---|---|---|
| EP | 0750716 | 11/1999 |
| EP | 0837978 | 12/1999 |

OTHER PUBLICATIONS

International Search Report and Written Opinion of PCT Application No. PCT/US2016/019921 dated Nov. 18, 2016: pp. 1-15.

(Continued)

*Primary Examiner* — Yong-Suk (Philip) Ro
(74) *Attorney, Agent, or Firm* — Chamberlain Hrdlicka

(57) ABSTRACT

A well apparatus includes a bottom hole assembly (BHA) comprising a cutting structure at one end of the BHA, a whipstock assembly for selectively deflecting the BHA to form a deviated wellbore, a whipstock connector releasably connecting the whipstock assembly to the BHA, and a whipstock support member extending between the BHA and the whipstock assembly and spaced from the whipstock connector.

19 Claims, 5 Drawing Sheets

(56) References Cited

U.S. PATENT DOCUMENTS

| | | | | |
|---|---|---|---|---|
| 5,806,596 | A * | 9/1998 | Hardy | E21B 7/061 166/117.6 |
| 5,826,651 | A | 10/1998 | Lee et al. | |
| 6,032,740 | A * | 3/2000 | Schnitker | E21B 29/06 166/117.5 |
| 6,302,198 | B1 | 10/2001 | Ritorto et al. | |
| 6,464,002 | B1 | 10/2002 | Hart et al. | |
| 6,648,068 | B2 * | 11/2003 | Dewey | E21B 7/061 166/117.5 |
| 6,719,045 | B2 | 4/2004 | Hart et al. | |
| 6,910,538 | B2 | 6/2005 | Tinker | |
| 7,178,609 | B2 | 2/2007 | Hart et al. | |
| 8,297,365 | B2 | 10/2012 | Dove | |
| 8,469,096 | B2 | 6/2013 | McGarian | |
| 8,739,900 | B2 | 6/2014 | Gregurek et al. | |
| 8,783,368 | B2 | 7/2014 | Eriksen et al. | |
| 8,794,311 | B2 | 8/2014 | Lauderdale | |
| 8,833,442 | B2 | 9/2014 | Ibragimov et al. | |
| 9,835,011 | B2 * | 12/2017 | Cronley | E21B 41/0035 |
| 2002/0170713 | A1 | 11/2002 | Haugen et al. | |
| 2009/0133877 | A1 | 5/2009 | Neff | |
| 2010/0012322 | A1 * | 1/2010 | McGarian | E21B 7/061 166/298 |
| 2012/0160493 | A1 | 6/2012 | Belew et al. | |
| 2012/0261193 | A1 * | 10/2012 | Swadi | E21B 7/061 175/61 |
| 2013/0112397 | A1 * | 5/2013 | McKay | E21B 7/061 166/117.6 |
| 2014/0262528 | A1 | 9/2014 | Desai et al. | |

OTHER PUBLICATIONS

Ngugi, "Technical, Economic and Institutional Evaluation of Adopting Directional Drilling by Kengen, Kenya," The United Nations University, Geothermal Training Programme, Report No. 9, 2002: pp. 113-146.

* cited by examiner

WHIPSTOCK ASSEMBLY WITH A SUPPORT MEMBER

BACKGROUND

This section is intended to provide background information to facilitate a better understanding of the various aspects of the described embodiments. Accordingly, it should be understood that these statements are to be read in this light and not as admissions of prior art.

Hydrocarbons can be produced through relatively complex wellbores traversing a subterranean formation. Some wellbores can include multilateral wellbores and/or sidetrack (i.e., deviated) wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either multilateral or sidetrack wellbores can be formed by positioning a whipstock in a casing string at a desired location in the main wellbore. The whipstock is used to deflect one or more mills or bottom hole assemblies laterally (or in an alternative orientation) relative to the casing string. The deflected mill(s) penetrates part of the casing joint to form the casing exit in the casing string. Drill bits can be subsequently inserted through the casing exit in order to cut the lateral or secondary wellbore.

The whipstock is initially positioned within the wellbore using either the bottom hole assembly (BHA) or a running tool. The BHA connects to the whipstock using a shear bolt, in which the shear bolt connection between the BHA and whipstock is sheared once the whipstock is positioned and secured (e.g., using a packer or other securing mechanism) within the wellbore. A running tool also could instead be used in the event that the shear bolt cannot withstand the forces and torques submitted thereto during the delivery and positioning of the whipstock. However, this increases the number of trips required downhole into the wellbore to complete the well.

BRIEF DESCRIPTION OF THE DRAWINGS

For a detailed description of the embodiments of the invention, reference will now be made to the accompanying drawings in which.

DETAILED DESCRIPTION

The present disclosure includes systems and methods for forming a wellbore using a bottom hole assembly (BHA) and a whipstock apparatus. As discussed below, the BHA may be used to deploy and position the whipstock assembly in a desired position and orientation within a wellbore. The well apparatus then includes a connector to releasably connect the BHA to the whipstock assembly, and a separate support member that extends between the BHA and the whipstock assembly and is spaced from the connector. The support member may be used to support the connection between the BHA and the whipstock assembly. For example, while torque may be transferred between the BHA and the whipstock assembly through the connector, the support member may also be used to transfer torque between the BHA and the whipstock assembly, particularly when the BHA is deploying and lowering the whipstock assembly within the wellbore. This arrangement, for example, may prevent the connector from prematurely disconnecting the whipstock assembly from the BHA. Once the BHA is disconnected from the whipstock assembly, the whipstock assembly includes a deflector surface to direct the BHA into a sidewall of a wellbore for the BHA to drill a deviated wellbore. Selected example embodiments are discussed below, for purpose of illustration, in the context of an offshore oil and gas system. However, it will be appreciated by those skilled in the art that the disclosed principles are equally well suited for use in other contexts, such as on other types of oil and gas rigs, including land-based oil and gas rigs.

Figure 1:
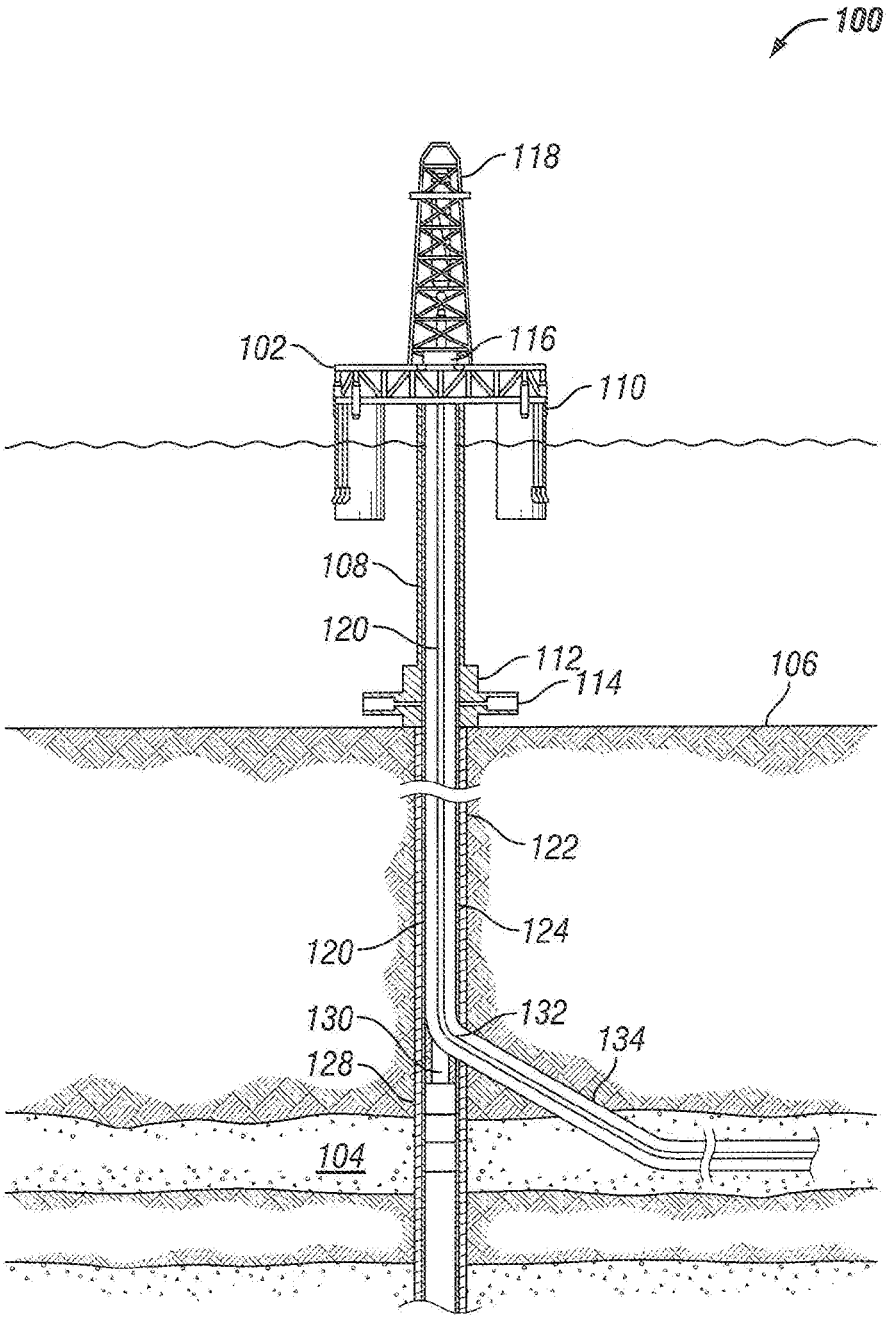
FIG. 1 is a schematic view of an offshore oil and gas system including a whipstock assembly, according to one or more embodiments.

FIG. 1 is a schematic view of an offshore oil and gas system 100 including a well tool or apparatus 128 having a whipstock assembly 130 in accordance with one or more embodiments of the present disclosure. The offshore oil and gas system 100 includes a platform 102, which may be a semi-submersible platform, positioned over a submerged oil and gas formation 104 located below the sea floor 106. A subsea conduit 108 extends from the deck 110 of the platform 102 to a wellhead installation 112 including one or more blowout preventers 114. The platform 102 has a hoisting apparatus 116 and a derrick 118 for raising and lowering pipe strings, such as a drill string 120.

As shown, a main wellbore 122 has been drilled through the various earth strata, including the formation 104. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. A casing string 124 may be at least partially cemented within the main wellbore 122. The term "casing" is used herein to designate a tubular string used to line a wellbore. Casing may actually be of the type known to those skilled in the art as "liner" and may be made of any material, such as steel or composite material and may be segmented or continuous, such as coiled tubing.

The well apparatus 128 may be installed in or otherwise form part of the casing string 124. The apparatus 128 may include a casing joint 126 interconnected between elongate portions or lengths of the casing string 124. The well apparatus 128 further includes the whipstock assembly 130, which may be positioned within the casing joint 126. The whipstock assembly 130 has a deflector surface that may be circumferentially oriented relative to the casing joint 126 such that a casing exit 132 can be milled, drilled, or otherwise formed in the casing joint 126 in a desired circumferential direction. As illustrated, the casing joint 126 is positioned at a desired intersection between the main wellbore 122 and a branch, sidetrack, deviated, or lateral wellbore 134. The terms "branch," "sidetrack," "deviated,"

or "lateral" wellbore are used herein to designate a wellbore that is drilled outwardly from its intersection with another wellbore, such as a parent or main wellbore. Moreover, a branch, sidetrack, deviated, or lateral wellbore may have another a branch, sidetrack, deviated, or lateral wellbore drilled outwardly therefrom.

For purpose of discussion, FIG. 1 illustrates a vertical section of the main wellbore 122, although the present disclosure is equally applicable for use in wellbores having other directional configurations including horizontal wellbores, deviated wellbores, slanted wellbores, combinations thereof, and the like. Moreover, use of directional terms such as above, below, upper, lower, upward, downward, uphole, downhole, and the like may be used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The casing joint 126 may be coupled to and otherwise interposing separate other casing joints within the casing string 124. In some embodiments, each end of the casing joint 126 may be threaded to other casing joints of the casing string 124. In other embodiments, however, the casing joint 126 may be coupled to the casing string 124 via couplings 207 made of, for example, steel or a steel alloy (e.g., low alloy steel).

The casing joint 126 may be made of a softer material or otherwise a material that provides easy milling or drilling therethrough. For example, the casing joint 126 may comprise aluminum or an aluminum alloy, or various composite materials such as, but not limited to, fiberglass, carbon fiber, combinations thereof, or the like. The use of non-ferrous materials such as aluminum or composite materials for the casing joint 126 helps ensure that cuttings resulting from the milling of the casing exit 132 through the casing joint 126 will not produce magnetically-charged debris that could magnetically-bind with downhole metal components or otherwise be difficult to circulate out of the well.

Figure 2:
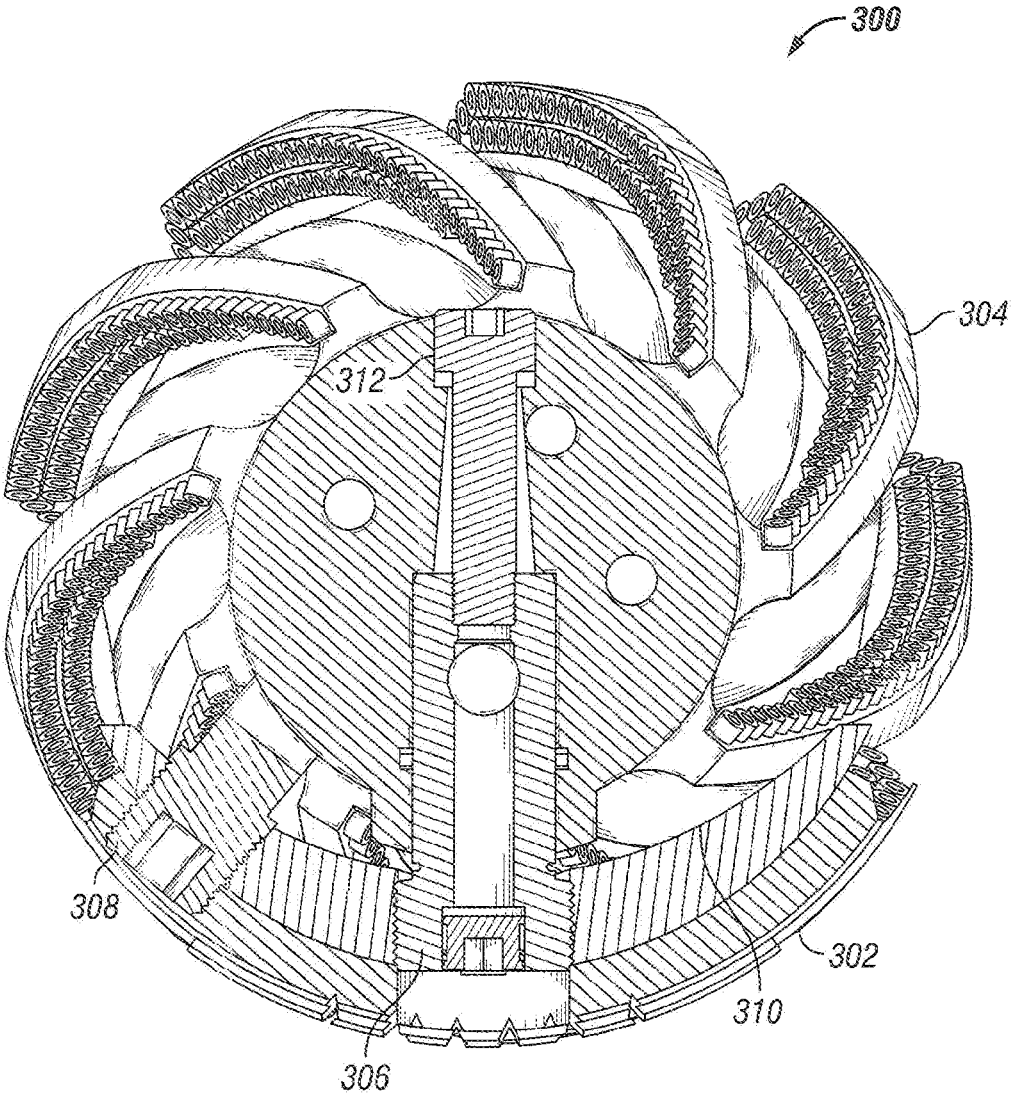
FIG. 2 is a cross-sectional view of a well apparatus, according to one or more embodiments.

Referring now to FIG. 2, a cross-sectional view of a well apparatus 300 for use with and positionable within a wellbore in accordance with the present disclosure is shown. The well apparatus 300 may be similar to the well apparatus 128 shown and discussed above, and may include one or more components or features as discussed below. As shown, the well apparatus 300 in this embodiment includes a whipstock assembly 302 that is connectable to a bottom hole assembly (BHA) 304. The BHA 304 may be used to deploy and position the whipstock assembly 302 in a desired position and orientation within a wellbore. Once in the desired position and orientation, the BHA 304 may then disconnect from the whipstock assembly 302, in which the whipstock assembly 302 may direct the BHA 304 in the process of drilling and forming a deviated wellbore. In one or more embodiments, the BHA 304 is shown as including a cutting structure, such as positioned at an end of the BHA 304. A BHA may be the lowest portion or end of a drill string, and may include one or more different components, such as drill collars, stabilizers, reamers, shocks, hole-openers, a motor, a bit sub, and a cutting structure. In this embodiment, the BHA 304 is shown as including a cutting structure, which is shown as a mill. However, the BHA may also include one or more other components, such as described above, without departing from the scope of the present disclosure.

The well apparatus 300 includes a connector 306 (e.g., whipstock connector) to releasably connect the whipstock assembly 302 to the BHA 304. The connector 306 physically and mechanically connects the whipstock assembly 302 and the BHA 304 to each other such that the whipstock assembly 302 and the BHA 304 are movable with each other. Further, though the whipstock assembly 302 and the BHA 304 are movable with each other, the whipstock assembly 302 and the BHA 304 are not movable with respect to each other when connected. The connector 306 also releasably connects the whipstock assembly 302 to the BHA 304, in that the connector 306 is used to release and disconnect the whipstock assembly 302 from the BHA 304 once the BHA deploys and positions the whipstock assembly in a desired position and orientation within a wellbore.

The well apparatus 300 further includes a support member 308 (e.g., whipstock support member) to support the connection between the BHA 304 and the whipstock assembly 302. The support member 308 is separate from and spaced from the connector 306 to support the connector 306 between the BHA 304 and the whipstock assembly 302. As shown, the support member 308 may be circumferentially spaced from the connector 306, but the support member 308 may also be axially spaced from the connector 308. The connector 306 and the support member 308 may each be positioned between the BHA 304 and the whipstock assembly 302. While the connector 306 may transfer torque between the BHA 304 and the support member 308, the support member 308 may also be used to transfer torque between the BHA 304 and the whipstock assembly 302, such as to reduce the torque and stress transferred through the connector 306 between the BHA 304 and the whipstock assembly 302. For example, as shown, the support member 308 may only be connected to the whipstock assembly 302 and then engage or contact the BHA 304 for the support member 308 to support the connection between the BHA 304 and the whipstock assembly 302.

Further, though only one connector 306 and one support member 308 are shown, the present disclosure contemplates that more than one connector 306 or more than one support member 308 may be used. For example, in an embodiment in which more than one connector is included, the connectors may be positioned circumferentially or axially with respect to each other about an axis of the BHA or the whipstock assembly. Additionally, in an embodiment in which more than one support member is included, the support members may be positioned circumferentially or axially with respect to each other about an axis of the BHA or the whipstock assembly.

Referring still to FIG. 2, the connector 306, as shown, may include a shear bolt such that a shearing force above the capacity of the shear bolt may shear the connector 306 to disconnect the BHA 304 from the whipstock assembly 302. The connector 306 in this embodiment may also include a cap screw 312 to secure the shear bolt in position between the BHA 304 and the whipstock assembly 302.

Figure 3:
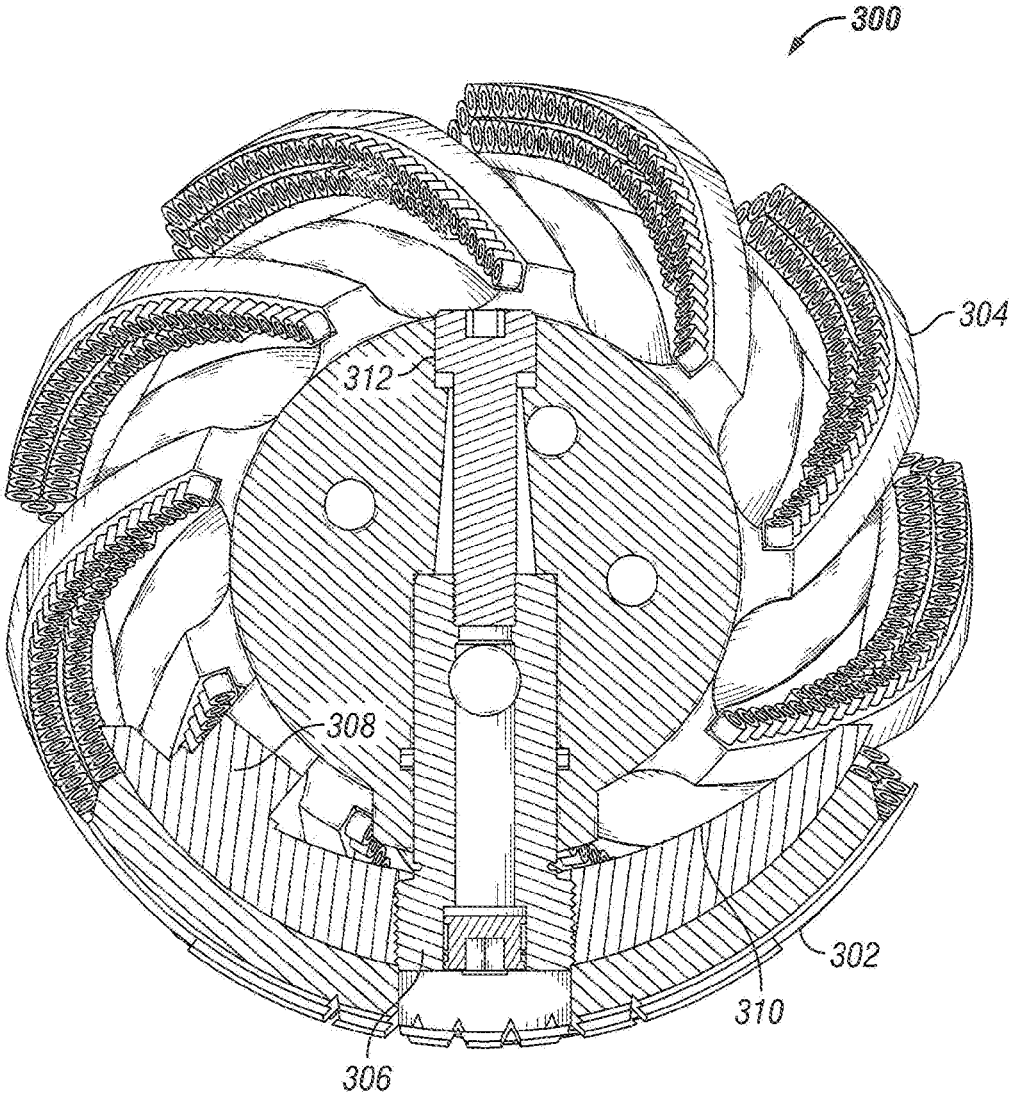
FIG. 3 is a cross-sectional view of a well apparatus, according to one or more embodiments.

As mentioned above, the support member 308 is separate from and spaced apart from the connector 306. The support member 308 the connection between the BHA 304 and the whipstock assembly 302 so as to prevent the connector 306 from prematurely disconnecting (e.g., shearing in the case of a shear bolt) when positioning the whipstock assembly 302 within a wellbore. For example, as shown, the support member 308 may be connected to the whipstock assembly 302, and then engage or contact the BHA 304 to transfer torque or force from BHA 304, through the support member 308, and to the whipstock assembly 302, thus absorbing some of the force or torque from the BHA 304 to the whipstock assembly 302 that would otherwise be transferred through the connector 306. In one or more embodiments, and as shown in FIG. 3, the support member 308 does not connect to the BHA 304, but instead only engages, contacts, or rests upon the BHA 304 to supports the connection between the BHA 304 and the whipstock assembly 302. The support member 308 may then be able to increase the net force, and particularly the torque, capacity of the connector 306 and the well apparatus 300, such as increasing the torque capacity from about 6,000 lb-ft (about 8,135 nm) to about 15,000 lb-ft (about 20,340 nm).

As mentioned above, the whipstock assembly 302 includes a deflector surface 310. After the BHA 304 is disconnected from the whipstock assembly 302, the BHA 304 may engage the deflector surface 310 of the whipstock assembly 302 such that the deflector surface 310 directs the BHA 304 into a sidewall of a wellbore. The whipstock assembly 302 may be tapered and/or curved to define the deflector surface 310. As shown, the support member 308 may be azimuthally spaced from the connector 306 with respect to the axis of the BHA 304 or the whipstock assembly 302, such as spaced by about 45 degrees apart from each other.

As shown, the support member 308 may protrude from or out of the deflector surface 310 to be engaged by the BHA 304. Further, the support member 308 may include or be formed from a material that is softer than that of the deflector surface 310. For example, the support member 308 may include or be formed from brass or aluminum, whereas the deflector surface 310 may include or be formed from steel (e.g., hardened steel). This may enable for the support member 308 to be removed (or at least a portion thereof) without also removing portions of the deflector surface 310. For example, once the BHA 304 has been disconnected from the whipstock assembly 302, the BHA 304 may be used to remove the portion of the support member 308 protruding from or out of the deflector surface 310, such as by milling and drilling the portion of the support member 308 protruding from or out of the deflector surface 310 with the BHA 304.

The support member 308 may be permanently or removably connected or coupled to the whipstock assembly 302. Further, the support member 308 may be adjustably coupled to the whipstock assembly 302 such that the support member 308 may be moved or adjusted with respect to the whipstock assembly 302 and/or the BHA 304. For example, as shown in FIG. 2, the support member 308 may be threadedly engaged with the whipstock assembly 302, in which the position (e.g., radial extension) of the support member 308 may be adjusted through the threaded engagement between the support member 308 and the whipstock assembly 302. Accordingly, in one or more embodiments, the support member 308 may include a nut, a bolt, and a screw. In one or more embodiments, the support member 308 may alternatively be a support block, and/or may include one or more recesses or protrusions such that a surface of shape of the support member 308 may complement the surface of the BHA 304 engaged by the support member 308. Further, in one or more embodiments, such as when the support member 308 is permanently (e.g., non-removably) connected to the whipstock assembly 302, the support member 308 may be welded, soldered, or otherwise affixed to the whipstock assembly 302. For example, FIG. 3 provides a cross-sectional view of the well apparatus 300 with the support member 308 permanently connected to the whipstock assembly 302. In this embodiment, the support member 308 may fixed to the whipstock assembly 302, as opposed to being movable with respect to the whipstock assembly 302.

Figure 4:
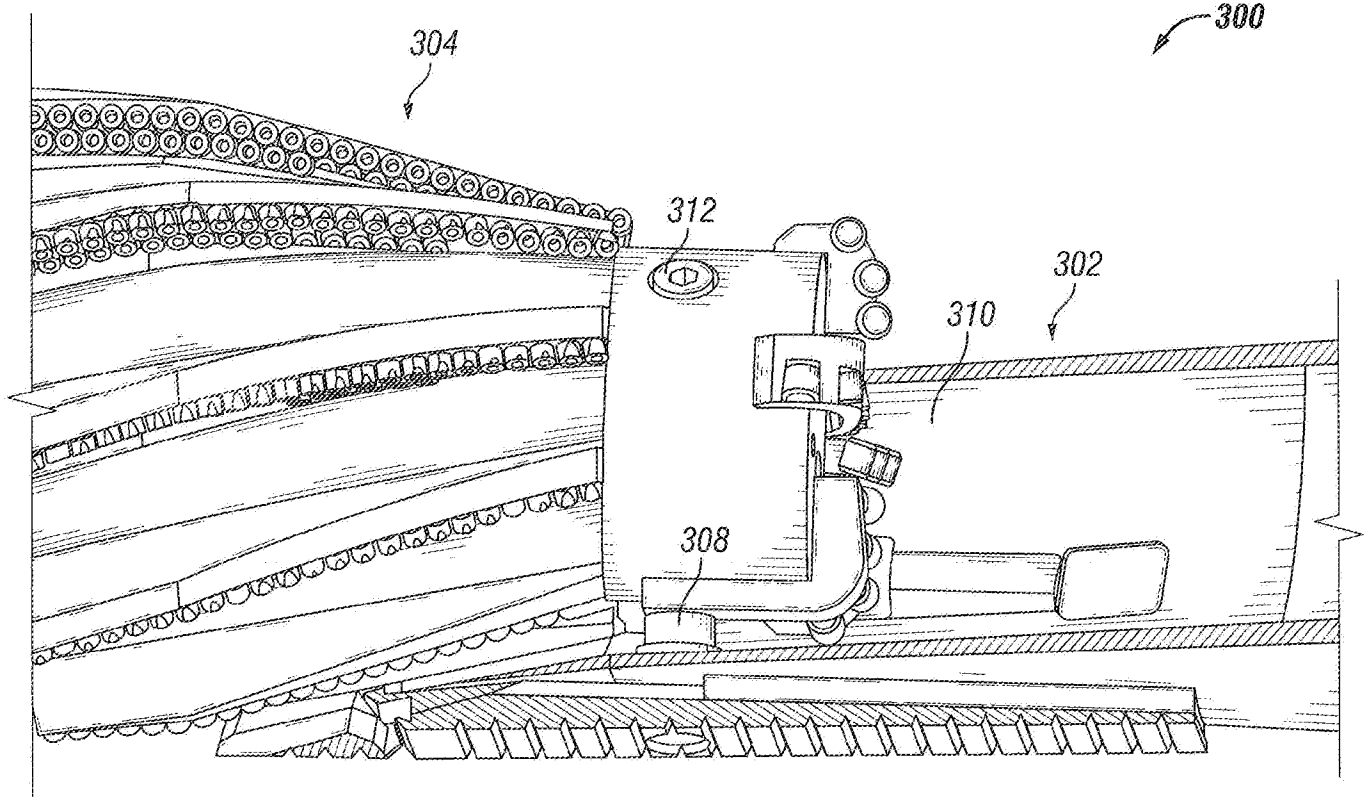
FIG. 4 is a side perspective view of a well apparatus, according to one or more embodiments.

FIG. 4 provides a side perspective view of the well apparatus 300 shown in FIG. 2 in accordance with one or more embodiments of the present disclosure is shown. As discussed above, the well apparatus 300 includes the whipstock assembly 302 releasably connectable to the BHA 304. The BHA 304 may be used to deploy and position the whipstock assembly 302 in a desired position and orientation within a wellbore. The well apparatus 300 then includes the connector 306 to connect the BHA 304 to the whipstock assembly 302, and the support member 308 to support the connector 306 and the connection between the BHA 304 and the whipstock assembly 302. The whipstock assembly 302 includes the deflector surface 310 to direct the BHA 304 into a sidewall of a wellbore after the BHA 304 is disconnected from the whipstock assembly 302. Also, this embodiment includes the cap screw 312 to secure the connector 306 in position between the BHA 304 and the whipstock assembly 302.

Figure 5:
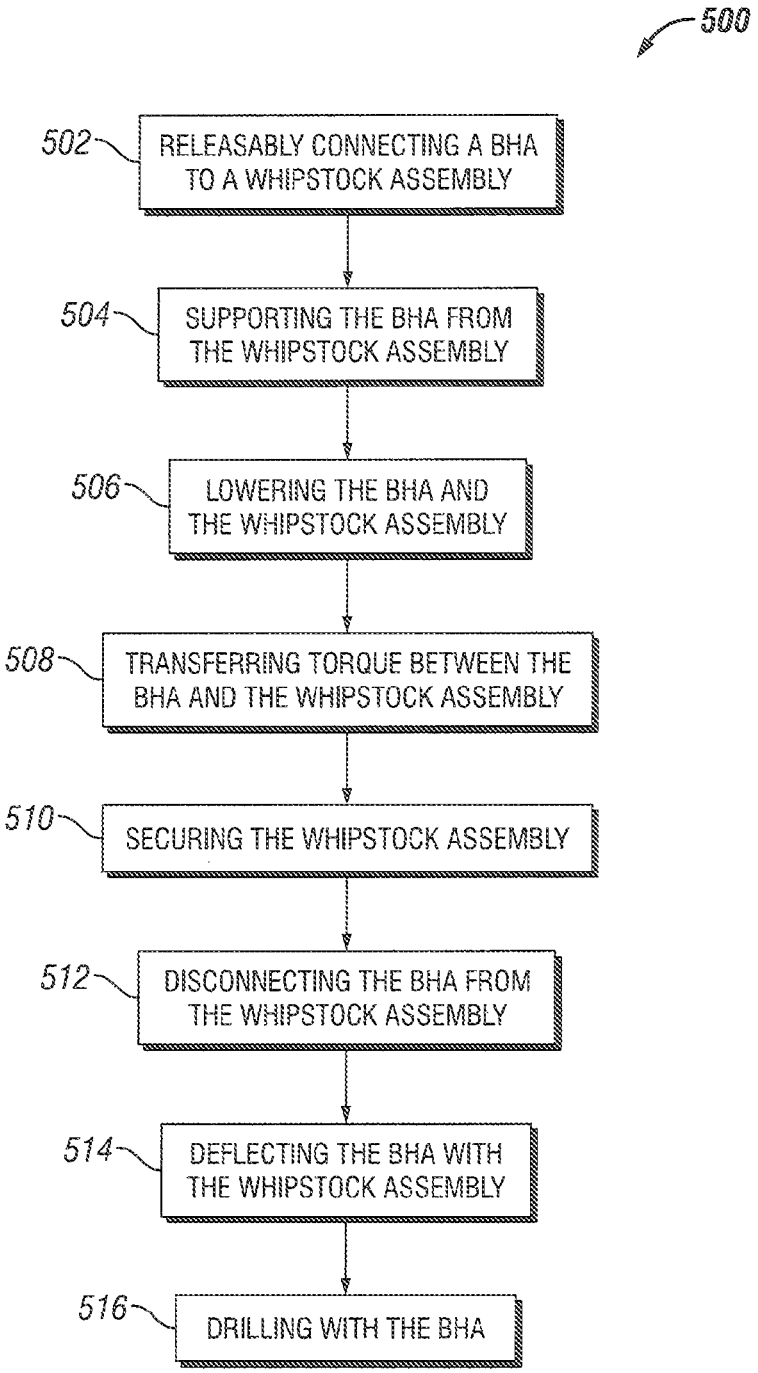
FIG. 5 is a flow chart of a method of using a well apparatus, according to one or more embodiments.

Referring now to FIG. 5, a flowchart of a method 500 for forming a wellbore in accordance with one or more embodiments of the present disclosure is shown. The method 500 includes releasably connecting a BHA to a whipstock assembly 502, such as by connecting the BHA and the whipstock assembly to each other using a connector positioned therebetween. The method 500 then further includes supporting the BHA from the whipstock assembly 504. For example, a support member may be spaced from the connector to separately support the BHA from the whipstock assembly, as opposed to only increasing the size or strength of the connector itself. As the support member may be movable with respect to the BHA and the whipstock assembly (e.g., movable with respect to an axis of the BHA or the whipstock assembly), the position of the support member may be adjusted with respect to the BHA and the whipstock assembly such that the support member is able to contact and engage the BHA as desired.

The BHA and the whipstock assembly may then be lowered into the wellbore 506. When lowering the BHA and the whipstock assembly into the wellbore, the BHA and/or the whipstock assembly may contact and hit obstructions within the wellbore or the wellbore wall itself before the BHA and the whipstock assembly have reach the desired depth within the wellbore. This may add undue or excessive force or stress to the connector between the BHA and the whipstock assembly. Accordingly, by additionally supporting the BHA from the whipstock assembly, the method 500 may include transferring torque between the BHA and the whipstock assembly 508 through the support member during the lowering 506. This may increase the overall torque that the whipstock assembly and the BHA may withstand during the lowering 506, such as before prematurely disconnecting or shearing the connector between the BHA and the whipstock assembly.

The method 500 may then further include securing the whipstock assembly 510 within the wellbore, such as when the whipstock assembly 510 reaches a desired depth and/or orientation within the wellbore, and then disconnecting the BHA from the whipstock assembly 512. For example, once the whipstock assembly is in at the desired depth and in the desired orientation, the connector between the BHA from the whipstock assembly may be disconnected (e.g., shearing a shear bolt) to set the whipstock assembly within the wellbore. As the BHA and the whipstock assembly are now movable with respect to each other, the method 500 then includes deflecting the BHA with the whipstock assembly 514, such as by having the deflector surface of the whipstock assembly engage the BHA and push the BHA towards the wellbore wall, and then drilling into the wall of the wellbore with the BHA 516 to form a deviated wellbore from the main wellbore.

As mentioned above, a well apparatus and a whipstock assembly in accordance with the present disclosure may be used when forming or extending a wellbore or wellbore system. In such an embodiment, the BHA may be connected to the whipstock assembly (e.g., on the surface, not downhole or within the wellbore), and the position of the support member may be adjusted with respect to the whipstock assembly and BHA, such as to ensure that the support member engages the BHA. The BHA and whipstock assembly may then together be lowered into the wellbore, with the support member supporting the connection between the BHA and the whipstock assembly.

Once the whipstock assembly is in the desired position within the wellbore, the whipstock assembly may then be secured within the wellbore, such as by using a packer or one of the other methods discussed above or known in the art. Once the whipstock assembly is then secured in position, the BHA may be disconnected from the whipstock assembly in the wellbore, such as by shearing the connector between the BHA and the whipstock in the event that the connector is a shear bolt. This enables the BHA to move separately and with respect to whipstock assembly in the wellbore. As such, the deflector surface of the whipstock assembly may be used to deflect the BHA towards a wall of the wellbore such that the BHA may drill into the wall and form a deviated wellbore.

In addition to the embodiments described above, many examples of specific combinations are within the scope of the disclosure, some of which are detailed below:

Example 1

A well apparatus, comprising:
a bottom hole assembly (BHA) comprising a cutting structure at one end of the BHA;
a whipstock assembly for selectively deflecting the BHA to form a deviated wellbore;
a whipstock connector releasably connecting the whipstock assembly to the BHA; and
a whipstock support member extending between the BHA and the whipstock assembly and spaced from the whipstock connector.

Example 2

The apparatus of Example 1, wherein the whipstock support member is engageable with the BHA to transfer torque from the BHA through the whipstock support member to the whipstock assembly.

Example 3

The apparatus of Example 1, wherein the cutting structure comprises a mill for drilling the deviated wellbore upon release of the whipstock connector from the BHA.

Example 4

The apparatus of Example 1, wherein the whipstock support member protrudes from a deflector surface of the whipstock assembly so as to be engageable with the BHA.

Example 5

The apparatus of Example 4, wherein the support member comprises a material softer than that of a deflector surface of the whipstock assembly for the cutting structure to drill through the whipstock support member protruding from the deflector surface.

Example 6

The apparatus of Example 1, wherein the whipstock support member is radially movably coupled to the whipstock assembly with respect to an axis of the BHA.

Example 7

The apparatus of Example 6, wherein the whipstock support member is threadedly engaged with the whipstock assembly to move the whipstock support member with respect to the whipstock assembly.

Example 8

The apparatus of Example 1, wherein the whipstock support member is circumferentially spaced from the whipstock connector with respect to an axis of the BHA.

Example 9

The apparatus of Example 1, wherein the whipstock connector comprises a shear bolt.

Example 10

The apparatus of Example 1, wherein the whipstock support member is not connected between the whipstock assembly and the BHA.

Example 11

The apparatus of Example 1, further comprising:
a plurality of whipstock connectors releasably connecting the whipstock assembly to the BHA; and
a plurality of whipstock support members extending between the BHA and the whipstock assembly.

Example 12

A method of forming a wellbore, the method comprising:
releasably connecting a bottom hole assembly (BHA) to a whipstock assembly with a whipstock connector;
supporting the BHA from the whipstock assembly with a whipstock support member spaced from the whipstock connector; and
lowering the BHA and the whipstock assembly into a wellbore.

Example 13

The method of Example 12, further comprising transferring torque between the BHA and the whipstock assembly through the whipstock support member while lowering the BHA and the whipstock assembly into the wellbore.

Example 14

The method of Example 12, further comprising:
securing the whipstock assembly within the wellbore;
disconnecting the BHA from the whipstock assembly in the wellbore;
deflecting the BHA with the whipstock assembly; and drilling into a wall of the wellbore with the BHA to form a deviated wellbore.

Example 15

The method of Example 14, wherein disconnecting the BHA from the whipstock assembly comprises shearing a shear bolt.

Example 16

The method of Example 12, wherein the supporting the BHA comprises:
connecting the whipstock support member to the whipstock assembly; and
engaging the BHA with the whipstock support member.

Example 17

The method of Example 16, wherein the engaging the whipstock comprises radially moving the whipstock support member with respect to an axis of the BHA.

Example 18

The method of Example 12, further comprising removing at least a portion of the support member with a cutting structure of the BHA.

Example 19

The method of Example 12, wherein the whipstock support member is circumferentially spaced from the whipstock connector with respect to an axis of the BHA.

Example 20

A well apparatus operable with a bottom hole assembly (BHA) within a wellbore, the apparatus comprising:
a whipstock assembly for selectively deflecting the BHA to form a deviated wellbore;
a whipstock connector releasably connecting the whipstock assembly to the BHA; and
a whipstock support member extending between the BHA and the whipstock assembly and circumferentially spaced from the whipstock connector.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Within this document, a reference identifier may be used as a general label, for example "101," for a type of element and alternately used to indicate a specific instance or characterization, for example "101A" and 101B," of that same type of element.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A well apparatus, comprising:
a bottom hole assembly (BHA) comprising a cutting structure at one end of the BHA;
a whipstock assembly for deflecting the BHA to form a deviated wellbore, the whipstock assembly comprising a whipstock support member extending between the BHA and a deflector surface of the whipstock assembly; and
a whipstock connector spaced from the whipstock support member and releasably connecting the whipstock assembly to the BHA; and
wherein the whipstock support member is engageable with the BHA to transfer torque from the BHA through the whipstock support member to the whipstock assembly and reduce torque transferred through the whipstock connector.

2. The apparatus of claim 1, wherein the cutting structure comprises a mill for drilling the deviated wellbore upon release of the whipstock connector from the BHA.

3. The apparatus of claim 1, wherein the whipstock support member protrudes from a deflector surface of the whipstock assembly so as to be engageable with the BHA.

4. The apparatus of claim 3, wherein the support member comprises a material softer than that of the deflector surface of the whipstock assembly for the cutting structure to drill through the whipstock support member protruding from the deflector surface.

5. The apparatus of claim 1, wherein the whipstock support member is radially movably coupled to the whipstock assembly with respect to an axis of the BHA.

6. The apparatus of claim 5, wherein the whipstock support member is threadedly engaged with the whipstock assembly to move the whipstock support member with respect to the whipstock assembly.

7. The apparatus of claim 1, wherein the whipstock support member is circumferentially spaced from the whipstock connector with respect to an axis of the BHA.

8. The apparatus of claim 1, wherein the whipstock connector comprises a shear bolt.

9. The apparatus of claim 1, wherein the whipstock support member is not connected between the whipstock assembly and the BHA.

10. The apparatus of claim 1, further comprising:

a plurality of whipstock connectors releasably connecting the whipstock assembly to the BHA; and a plurality of whipstock support members extending between the BHA and the whipstock assembly.

11. A method of forming a wellbore, the method comprising:

releasably connecting a bottom hole assembly (BHA) to a whipstock assembly with a whipstock connector;

supporting the BHA from the whipstock assembly with a whipstock support member of the whipstock assembly that is engaged with the BHA to transfer torque from the BHA through the whipstock support member to the whipstock assembly and reduce torque transferred through the whipstock connector, the whipstock support member spaced from the whipstock connector; and lowering the BHA and the whipstock assembly into a wellbore.

12. The method of claim 11, further comprising transferring torque between the BHA and the whipstock assembly through the whipstock support member while lowering the BHA and the whipstock assembly into the wellbore.

13. The method of claim 11, further comprising:

securing the whipstock assembly within the wellbore;

disconnecting the BHA from the whipstock assembly in the wellbore;

deflecting the BHA with the whipstock assembly; and drilling into a wall of the wellbore with the BHA to form a deviated wellbore.

14. The method of claim 13, wherein disconnecting the BHA from the whipstock assembly comprises shearing a shear bolt.

15. The method of claim 11, wherein the supporting the BHA comprises: connecting the whipstock support member to the whipstock assembly; and engaging the BHA with the whipstock support member.

16. The method of claim 15, wherein the engaging the whipstock comprises radially moving the whipstock support member with respect to an axis of the BHA.

17. The method of claim 11, further comprising removing at least a portion of the support member with a cutting structure of the BHA.

18. The method of claim 11, wherein the whipstock support member is circumferentially spaced from the whipstock connector with respect to an axis of the BHA.

19. A well apparatus operable with a bottom hole assembly (BHA) within a wellbore, the apparatus comprising:

a whipstock assembly for deflecting the BHA to form a deviated wellbore, the whipstock assembly comprising a whipstock support member extending between the BHA and a deflector surface of the whipstock assembly;

a whipstock connector releasably connecting the whipstock assembly to the BHA, the whipstock connector circumferentially spaced from the whipstock support member; and wherein the whipstock support member is engageable with the BHA to transfer torque from the BHA through the whipstock support member to the whipstock assembly and reduce torque transferred through the whipstock connector.

* * * * *